US005573439A

United States Patent [19]

Turner et al.

[11] Patent Number: 5,573,439

[45] Date of Patent: Nov. 12, 1996

[54] INFLATABLE BALLOON WITH AT LEAST ONE FLAP MEMBER FOR CONCEALING OR EXPOSING A GRAPHIC DESIGN

[75] Inventors: Cheryl S. Turner; Eli J. Turner, both of Wimberly, Tex.; Lisa M. Van Dusen, Wichita, Kans.

[73] Assignee: Continental American Corporation, Wichita, Kans.

[21] Appl. No.: 349,536

[22] Filed: Dec. 5, 1994

[51] Int. Cl.[6] ..... A63H 3/06

[52] U.S. Cl. ..... 446/226; 446/220; 446/321

[58] Field of Search ..... 446/220–226, 446/149–151, 321; D21/84; 40/212, 214

[56] References Cited

U.S. PATENT DOCUMENTS

| | | | |
|---|---|---|---|
| 1,924,236 | 8/1933 | Friedberg | 446/220 |
| 2,028,797 | 1/1936 | Miller | 446/226 |
| 2,975,534 | 3/1961 | Lutz | 446/226 |
| 3,048,395 | 8/1962 | Hobbs | 446/220 |
| 3,487,573 | 6/1970 | Slovacek | 446/149 |
| 3,747,264 | 7/1973 | Brandwein | 446/329 |
| 3,811,220 | 5/1974 | Glass | 446/321 |
| 4,125,233 | 11/1978 | Winker | 446/225 |
| 4,778,431 | 10/1988 | Dudley . | |
| 4,919,365 | 4/1990 | Mears | 446/220 |
| 5,117,344 | 5/1992 | Perez . | |
| 5,257,823 | 11/1993 | Colvin | 446/149 |
| 5,378,186 | 1/1995 | Becker | 446/220 |

FOREIGN PATENT DOCUMENTS

| | | | |
|---|---|---|---|
| 420386 | 4/1991 | European Pat. Off. | 446/220 |
| 565028 | 11/1932 | Germany | 446/222 |
| 405003970 | 1/1993 | Japan | 446/220 |

OTHER PUBLICATIONS

Qualatex Best Bets Catalog, printed by Continental American Corporation.

Anagram Balloons Catalog.

*Primary Examiner*—Robert A. Hafer

*Assistant Examiner*—Jeffrey D. Carlson

*Attorney, Agent, or Firm*—Stinson, Mag & Fizzell

[57] ABSTRACT

The invention is an inflatable balloon, having an inflatable chamber; a graphic design on at least a portion of the inflatable chamber; a flap member adjoining the inflatable chamber; the flap member having a first position and a second position, wherein the first position conceals at least a portion of the graphic design on the inflatable chamber; and the second position allows at least a portion of the concealed portion of the graphic design to be exposed.

18 Claims, 8 Drawing Sheets

INFLATABLE BALLOON WITH AT LEAST ONE FLAP MEMBER FOR CONCEALING OR EXPOSING A GRAPHIC DESIGN

FIELD OF THE INVENTION

The invention relates to inflatable balloons having a graphic design on at least a portion of its inflatable chamber and at least one flap member adjoining the inflatable chamber. The flap member normally has a graphic design on its front and back faces which is generally complimentary to the graphic design on the inflatable chamber. The inflatable balloons may be used for marketing, advertising, gifts, decorations, etc.

BACKGROUND INFORMATION

Numerous shaped balloons made of various types of materials are currently on the market. People have found that balloons are useful in marketing and advertising as well as for gifts and novelties for clients, persons that are ill, birthdays and other events wherein a gift is normally given. For example, balloon bouquets are often sent in place of flowers. Balloons are also used extensively in decorating conventions, dances, weddings and other events that require a festive atmosphere.

Although an extensive number of types, shapes, sizes and colors of balloons exist, no balloons currently sold or marketed have an attached flap which may be positioned to either expose or conceal a graphical image on the inflated chamber of the balloon. Neither are there balloons wherein the flap itself is an integral part of the graphical design on the balloon. For example, the flap could conceal a written message, "I love you", such that when the flap was lifted, the message would be exposed. Additionally, the balloon could be animal-shaped. For example, an ape-shaped balloon could have a flap which forms an integral part of the ape's mouth such that when the flap was in one position, the mouth of the ape is closed, and when the flap was lifted, the mouth of the ape is open.

Consequently, a need exists for an inflatable balloon having a graphic design on at least a portion of its inflatable chamber and at least one flap member adjoining the inflatable chamber such that the flap member conceals or exposes, depending on its position, a portion of the graphical design on the inflatable chamber of the inflatable balloon.

SUMMARY OF THE INVENTION

The invention is an inflatable balloon, generally comprising an inflatable chamber with a graphic design on at least a portion of the inflatable chamber and at least one flap member adjoining the inflatable chamber. The flap member has a first position and a second position. The first position conceals at least a portion of the graphic design on the inflatable chamber yielding a concealed portion, and the second position allows the concealed portion of the graphic design to be exposed.

The flap member is generally comprised of a front face and a back face, such that the back face is proximate to the inflatable chamber. In some instances, at least a portion of the back face of the flap member has a graphic design complimentary to at least a portion of the concealed portion of the graphic design on the inflatable chamber, and/or at least a portion of the front face of the flap member has a graphic design complimentary to at least a portion of the non-concealed portion of the graphic design on the inflatable chamber.

One alternative embodiment of the inflatable balloons of this invention has an inflatable chamber which has an animal-like shape. The graphic design on the animal-like shaped inflatable chamber compliments the animal shape to create a physical image of an animal. In this embodiment, the flap members are generally an integral part of the design. For example, in one embodiment, at least a portion of the graphic design on the back face of the flap member and at least a portion of the concealed portion of the graphic design on the inflatable chamber creates the image of an animal with an open mouth when the flap member is in the second position, i.e. lifted, and at least a portion of the graphic design on the front face of the flap member and at least a portion of the non-concealed portion of the graphic design on the exterior side of the inflatable chamber create the image of an animal with a closed mouth when the flap member is in the first position. In other embodiments wherein the inflatable chamber has an animal-like shape, the flap members could take different shapes than mouths, such as glasses which flip up and down, eye patches, head bands, necklaces, etc.

The inflatable balloon may also be shaped as a human or any inanimate object. For example, at Christmas time a balloon may be shaped like Santa Claus and the flap could be an integral part of his body, such as his mouth, beard, hat, etc., or could even be part of his sled, bag of toys, list of good boys and girls, etc.

In conjunction with any embodiment, the flap member or a portion thereof may be inflatable to add definition and shape to the flap member.

As an additional feature, the flap member may also have a component which could add shape and/or maintain the flap member in a desirable position. For example, the component could be a rod attached to the flap member to assure a longer flap member remains extended. For example, if the flap member is an elephant's trunk, the flap member may be inflated and also attached to a rod to assure the elephant's trunk remains extended and does not fold up. In other embodiments, it may be desirable for the elephant's trunk to roll up. In these instances, the flap member may be partially inflated and attached to a component that is capable of acting like a locking spring. When in the locked position, the spring and trunk would be extended. In the unlocked position, the spring would recoil, thus rolling up or shortening the trunk.

In other embodiments of this invention, a portion of the concealed graphic on the inflatable chamber is a typographical message which is exposed when the flap member is lifted.

The inflatable balloons of this invention may also have more than one flap member, dependent on the design requirements.

As is evident from the description above, each of the designs may include various features described above dependent on the design requirements.

BRIEF DESCRIPTION OF THE DRAWINGS

FIG. 7A is front view of an inflatable balloon shaped as a small child with the flap member in the first position to create the image of a child with a birthday hat on.

DETAILED DESCRIPTION OF THE PREFERRED EMBODIMENT

Numerous Figures have been included which illustrate various types and sizes of inflatable balloons of this invention. Although the shape and position of the balloon part being described may be different, the numbers used to designate each balloon part are the same on each diagram. The same numbers were used to maintain continuity and obtain clarity.

Figure 1A:
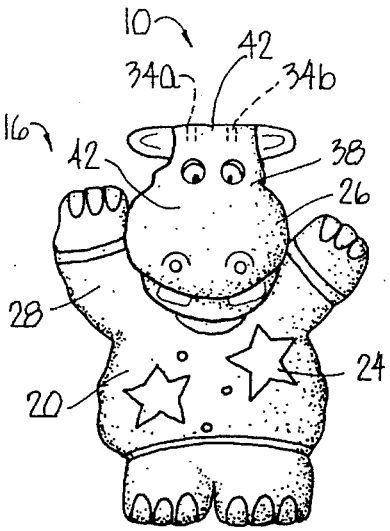
FIG. 1A is a front view of an inflatable balloon shaped as a rhinoceros with the flap member in the first position to create the image of a rhinoceros with his mouth closed.
Figure 1B:
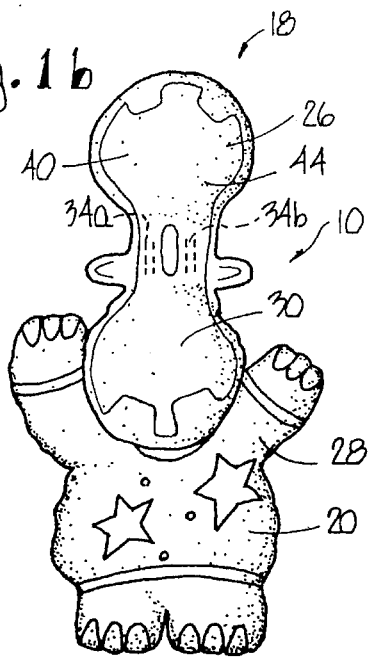
FIG. 1B is a front view of an inflatable balloon shaped as a rhinoceros with the flap member in the second position to create the image of a rhinoceros with his mouth open.

Referring to FIGS. 1A and 1B, inflatable balloon 10 is comprised of inflatable chamber 20, graphic design 24 on at least a portion of inflatable chamber 20; and at least one flap member 26 adjoining inflatable chamber 20. Inflatable balloon 10 generally has a graphic design 24 on at least a portion of inflatable chamber 20. Graphic design 24 is comprised of an exposed portion 28 and a concealed portion 30.

Flap member 26 has first position 16 and second position 18. Flap member 26 is in first position 16 in FIG. 1A. Flap member 26 is in second position 18 in FIG. 1B. First position 16 covers concealed portion 30 of graphic design 24 on said inflatable chamber 20. Second position 18 allows concealed portion 30 of graphic design 24 to be exposed.

Flap member 26 is comprised of front face 38 and back face 40. Back face 40 is proximate to inflatable chamber 20 when flap member 26 is in its first position 16. Various options are available for decorating the flap member 26. For example, front face 38 of flap member 26 may have a graphic design 42 complimentary to at least a portion of graphic design 24. Back face 40 may have a graphic design 44 complimentary to at least a portion of graphic design 24. Both front face 38 and back face 40 of flap member 26 may have graphic designs 42 and 44 respectively that are complimentary to graphic design 44. As is evident, the combinations are too many to recite.

Flap member 26 is either (1) an integral part of inflatable chamber 20 such that flap member 26 is inflated when inflatable chamber 20 is inflated; (2) an integral part of inflatable chamber 20 but is not inflated when inflatable chamber is inflated; (3) a combination of 1 and 2; or (4) is an entirely separate attachment fixed to inflatable chamber 20 after it is manufactured. By integral part, the inventor means that the flap member is manufactured as part of the balloon, not added separately after manufacture.

For example, in FIGS. 1A and 1B flap member 26 is an integral part of inflatable chamber 20 such that flap member 26 inflates when inflatable chamber 20 is inflated. Inflation is effected by passages 34*a* and 34*b* from inflatable chamber 20 to flap member 26.

Figure 6A:
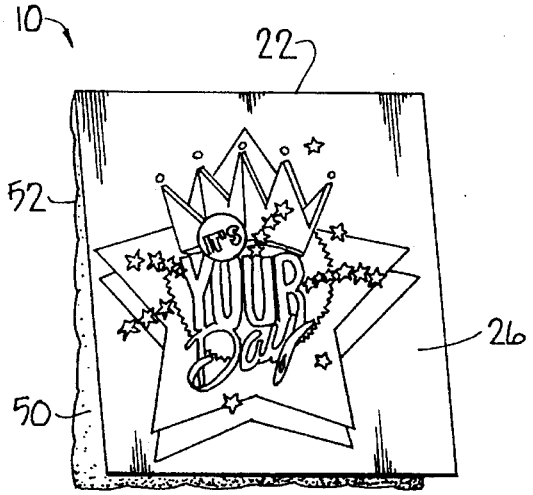
FIG. 6A is a front view of an inflatable balloon with a non-inflated flap member in the first position.
Figure 6B:
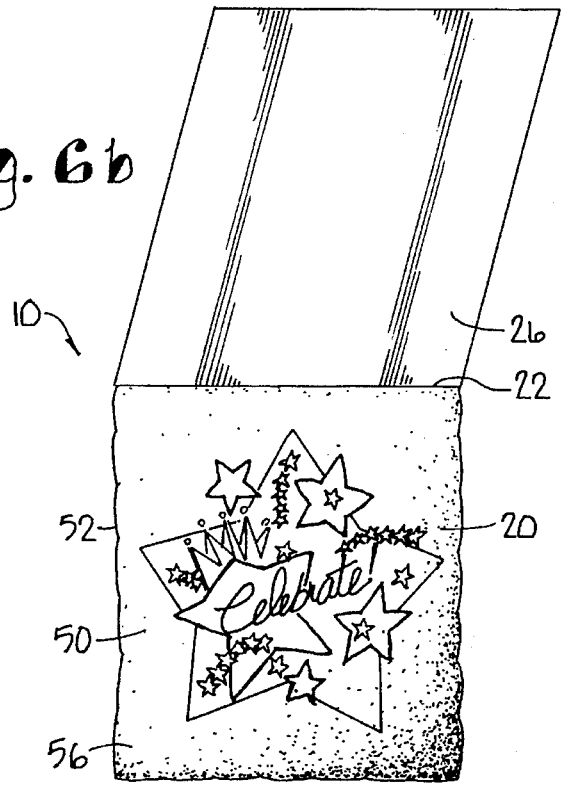
FIG. 6B is a front view of an inflatable balloon with a non-inflated flap member in the second position to expose a typographical message.

FIGS. 6A and 6B illustrate flap member 26 being an integral part of inflatable chamber 20 but not inflatable. Seam 22 prohibits air from passing into flap member 26.

Figure 5A:
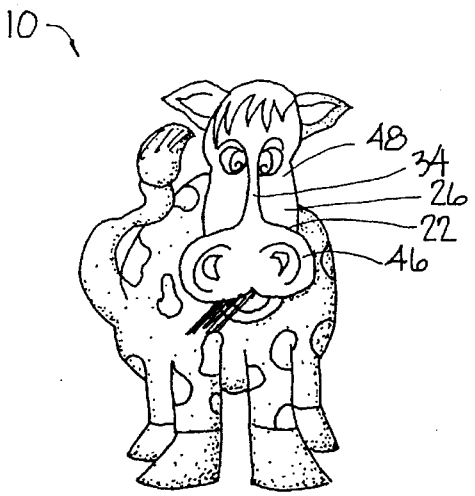
FIG. 5A is front view of an inflatable balloon shaped as a cow with the flap member in the first position to create the image of a cow with his mouth closed.
Figure 5B:
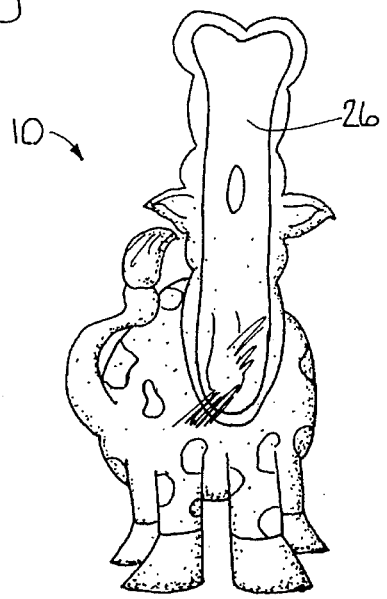
FIG. 5B is a front view of an inflatable balloon shaped as a cow with the flap member in the second position to create the image of a cow with his mouth open.

FIGS. 5A and 5B illustrate option 3 wherein a portion of flap member 26 is both inflated and not inflated. In FIG. 5A flap member 26 is comprised of inflatable section 46 and non-inflatable section 48. Again, inflation occurs via passage 34 which is disguised as a portion of the cow's nose while seam 22 prevents air from entering non-inflatable section 48 of flap member 26.

Figure 9:
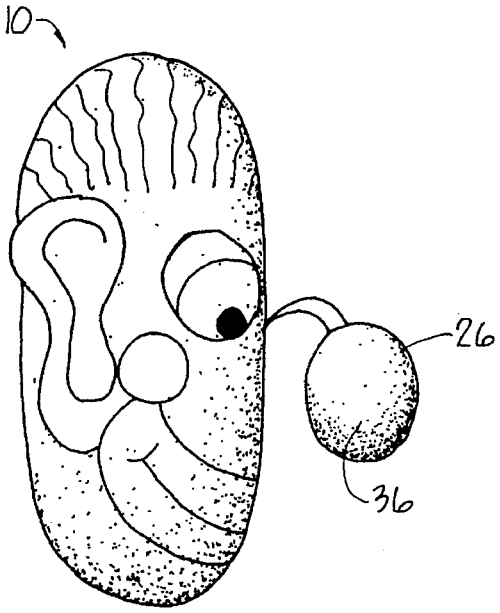
FIG. 9 is a side view of an inflatable balloon shaped as a clown with an attached inflated flap member as the clown's nose.

FIG. 9 illustrates flap member 26 as a separate attachment and not an integral part of inflatable chamber 20, i.e. flap member 26 is manufactured separately. In FIG. 9, flap member 26 is separately inflated via fill tab 36 of flap member 26. In other embodiments not shown, separately attached flap member 26 is not inflated. Separately attached flap member 26 is made of any material which the design requires including, MICROFOIL, latex, paper, plastic, cardboard, tissue, etc.

Figure 16A:
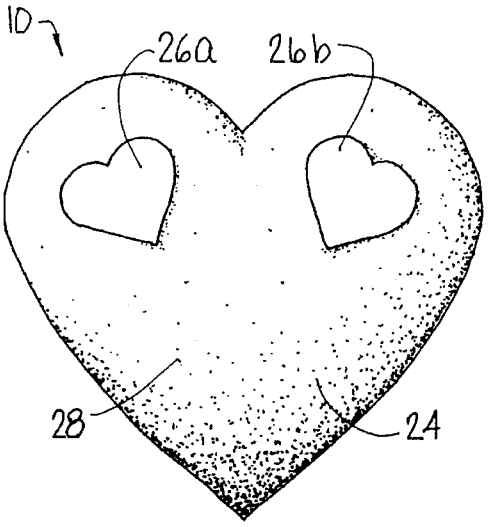
FIG. 16A is a front view of an inflatable balloon shaped as a heart with two flap members shaped as hearts, both in the first position to conceal the messages under the flap members.
Figure 16B:
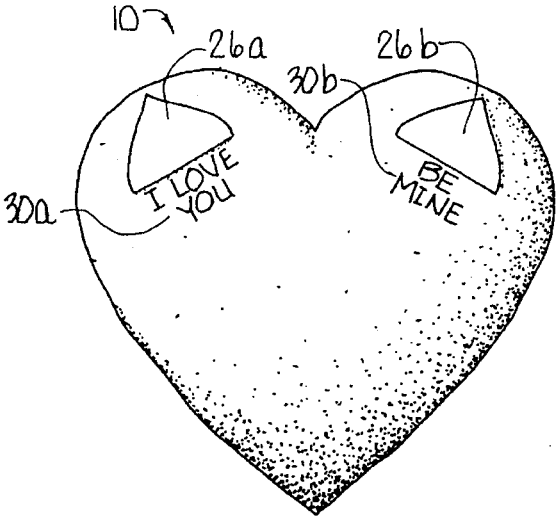
FIG. 16B is a front view of an inflatable balloon shaped as a heart with two flap members shaped as hearts, both in the second position to expose the messages under the flap members.

A plurality of flap members 26 taking any of the forms above listed may also be used. For example, FIGS. 16A and 16B illustrate inflatable balloon 10 which has two flap members 26*a* and 26*b*. Graphic design 24 is comprised of exposed portion 28 which in FIGS. 16A and 16B is a solid color, and concealed portions 30*a* and 30*b* which state, respectively, "I love you" and "Be mine".

In FIGS. 1A–4B and 8A–8B, inflatable chamber 20 is shaped as an animal, and graphic design 24 is drawn to compliment the animal shape. In FIGS. 1A–1B, graphic design 24 is a rhinoceros. In FIGS. 1A–1B, flap member 26 is an integral part of the design, being the upper snout of the rhinoceros. Flap member 26 is inflated via passages 34*a* and 34*b*. In FIGS. 1A and 1B, graphic design 42 of front face 38 of flap member 26 is the front of the rhinoceros' snout, and graphic design 44 of back face 40 of flap member 26 is the roof of the rhinoceros' mouth. In FIG. 1A, flap member 26 is in the first position wherein flap member 26 is pulled downwards by gravity and conceals concealed portion 30 of graphic design 24. In FIG. 1B, flap member 26 is in the second position to expose concealed portion 30 and give the appearance that the rhinoceros' mouth is open. Similar poses with various animals are illustrated in FIGS. 2A–5B and 8A–8B.

Figure 3A:
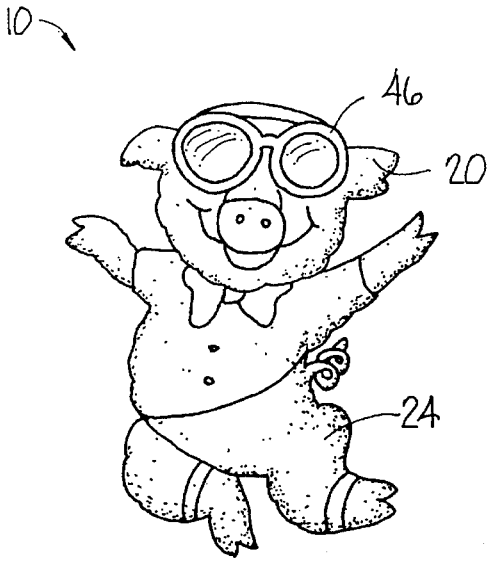
FIG. 3A is a front view of an inflatable balloon shaped as a pig with the flap member shaped like glasses and in the first position.
Figure 3B:
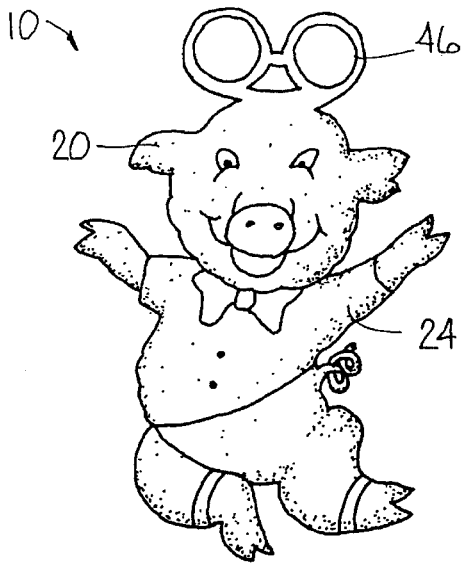
FIG. 3B is a front view of an inflatable balloon shaped as a pig with the flap member shaped like glasses and in the second position to expose the pig's eyes.
Figure 4A:
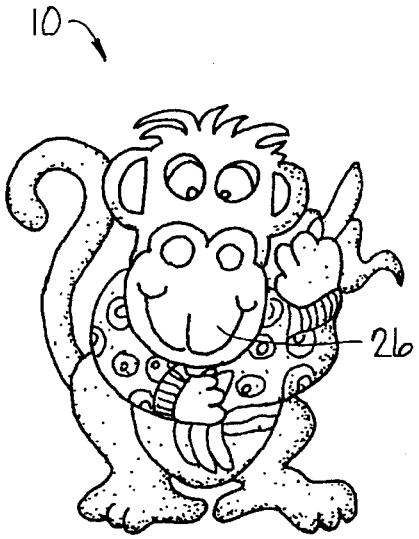
FIG. 4A is front view of an inflatable balloon shaped as a monkey with the flap member in the first position to create the image of a monkey with his mouth closed.
Figure 4B:
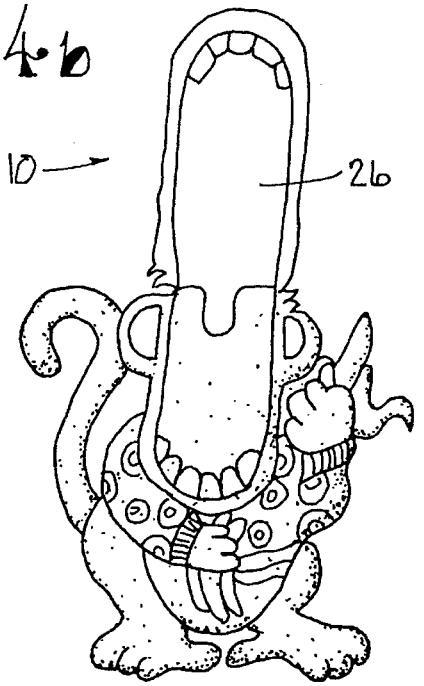
FIG. 4B is a front view of an inflatable balloon shaped as a monkey with the flap member in the second position to create the image of a monkey with his mouth open.

FIGS. 3A and 3B illustrate inflatable balloon 10 shaped as a pig. Instead of flap member 26 being a portion of the pigs snout, flap member 26 is a pair of glasses.

Figure 2A:
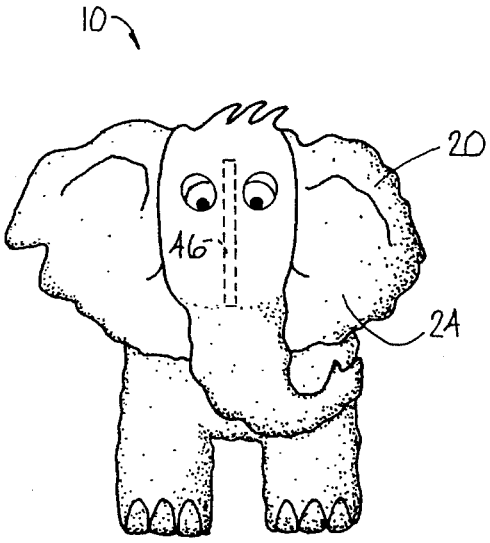
FIG. 2A is a front view of an inflatable balloon shaped as an elephant with the flap member in the first position to create the image of an elephant with his trunk down.
Figure 2B:
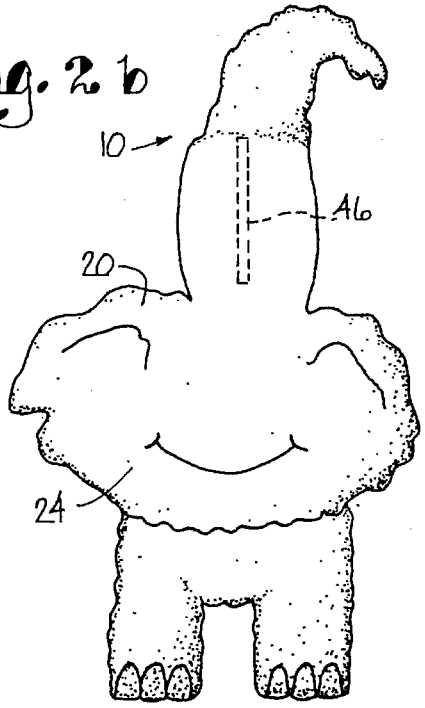
FIG. 2B is a front view of an inflatable balloon shaped as an elephant with the flap member in the second position to create the image of an elephant with his trunk lifted.

Inflatable balloon 10 may be further comprised of component 46. In FIGS. 2A and 2B, component 46 is a rod and is fixedly attached to flap member 26 such that it is not exposed. Component 46, in FIGS. 2A and 2B, is used to maintain the extension of the elephant's trunk, i.e., flap member 26. In FIGS. 3A and 3B, component 46 is a set of rings attached to flap member 26 to help create the image of a pair of glasses. In other embodiments, although not illustrated, component 46 may be a spring system connected to flap member 26 such that in the locked position the spring is extended and thus simultaneously extends the flap member, and in the unlocked position the spring is recoiled pulling back flap member 26 to the desired locale; a geometrical shaped ring attached to flap member 26 imparting a three-dimensional image of the shape of the ring, for example, the ring could be heart-shaped, circular, square, or any other geometrical shape that the design requires; and other components that add shape or definition to the flap member.

As FIGS. 6A–6B, 11A–16B illustrate inflatable balloon 10 and flap member 26 may be shaped to create the image of generally any inanimate object, depending on the design requirement. In FIGS. 6A–6B and 11A–16B flap member 26 is an integral part of the design and thus can be manufactured to be inflatable or non-inflatable or a combination of both as was illustrated in FIGS. 5A and 5B. In FIGS. 12A–13B and FIGS. 15A and 15B, flap member 26 is the top of a box. In FIGS. 14A and 14B, flap member 26 is a cloud.

Figure 7A:
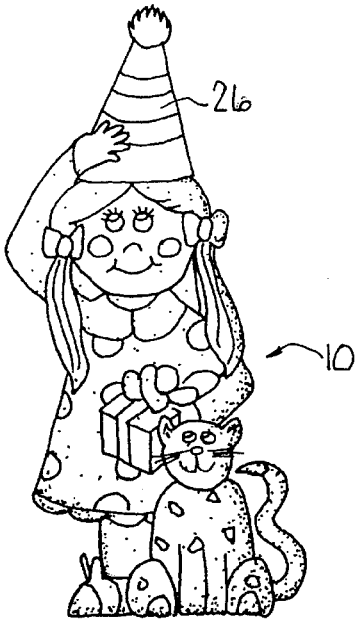
Figure 7B:
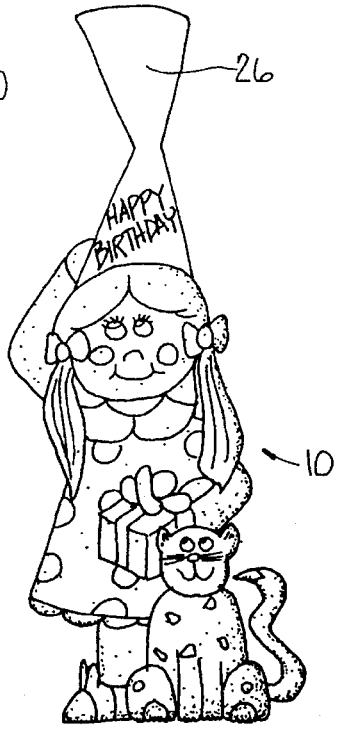
FIG. 7B is a front view of an inflatable balloon shaped as a small child with the flap member in the second position to expose birthday greetings.
Figure 8A:
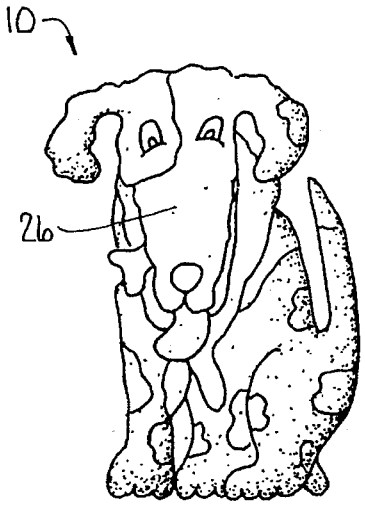
FIG. 8A is a front view of an inflatable balloon shaped as a dog with a bone in his mouth with the flap member in the first position to create the image of a dog with his mouth closed.
Figure 8B:
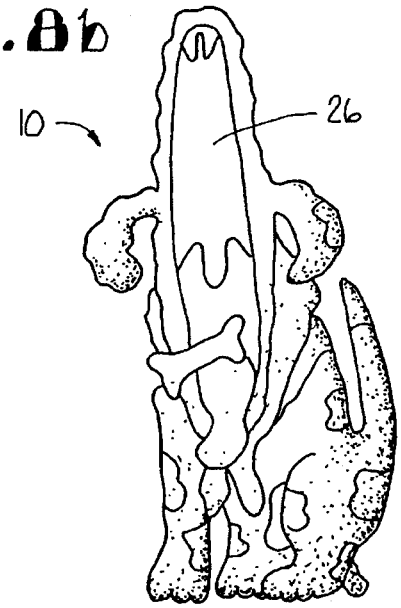
FIG. 8B is a front view of an inflatable balloon shaped as a dog with the flap member in the second position to create the image of a dog with his mouth open.

As shown in FIGS. 7A, 7B and 9–10B, inflatable balloon 10 and flap member 26 may be shaped to create the image of a human as well. In FIGS. 7A and 7B, inflatable chamber is shaped as a small child. Flap member 26 is the small child's birthday hat. When flap member 26 is lifted, birthday greetings are exposed.

Figure 17:
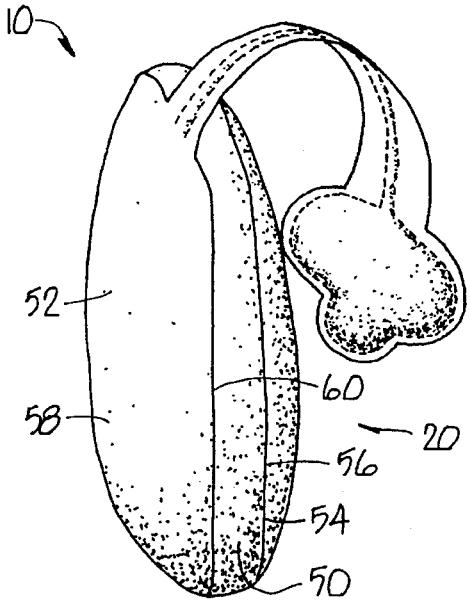
FIG. 17 is a side view of an inflatable balloon.
Figure 10A:
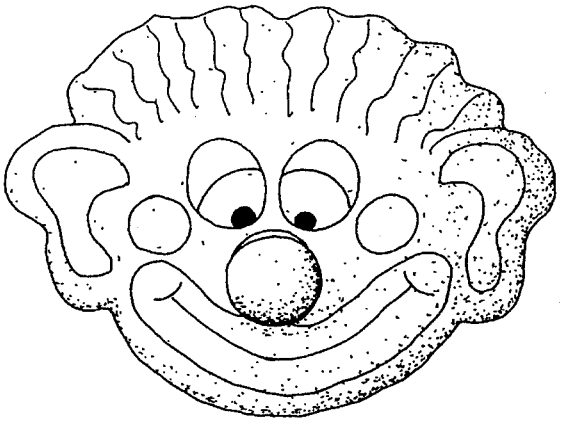
FIG. 10A is a front view of an inflatable balloon shaped as a clown's face with the nose-shaped flap member in the first position to create the image of a clown's face.
Figure 10B:
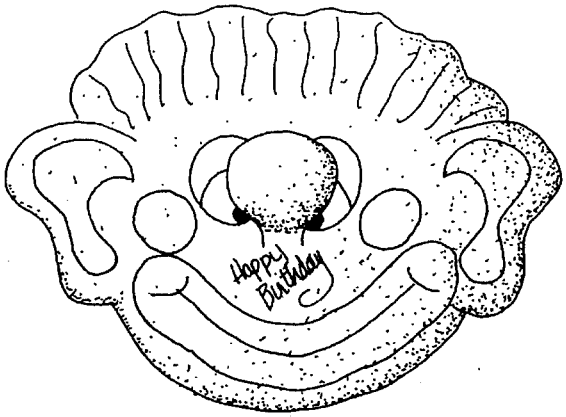
FIG. 10B is a front view of an inflatable balloon shaped as a clown's face with the nose-shaped flap member in the second position to expose a birthday greeting.
Figure 12A:
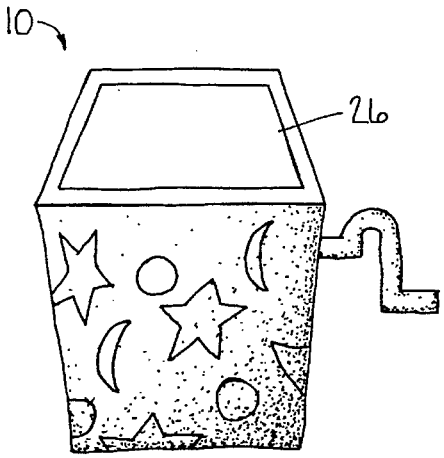
FIG. 12A is a front view of an inflatable balloon shaped like a jack-in-the-box with the flap member in the first position to create the image of a jack-in-the-box with the lid closed.
Figure 12B:
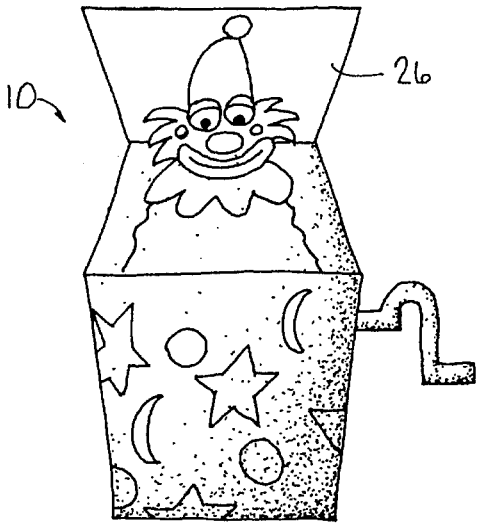
FIG. 12B is a front view of an inflatable balloon shaped like a jack-in-the-box with the flap member in the second position to create the image of a jack-in-the-box with the lid open.
Figure 15A:
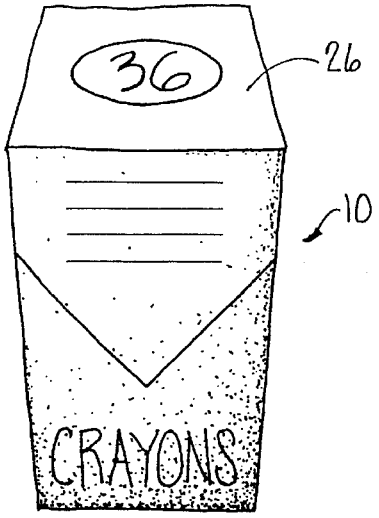
FIG. 15A is a front view of an inflatable balloon shaped as a box of crayons with the flap member in the first position to create the image of a box of crayons with the lid closed.
Figure 15B:
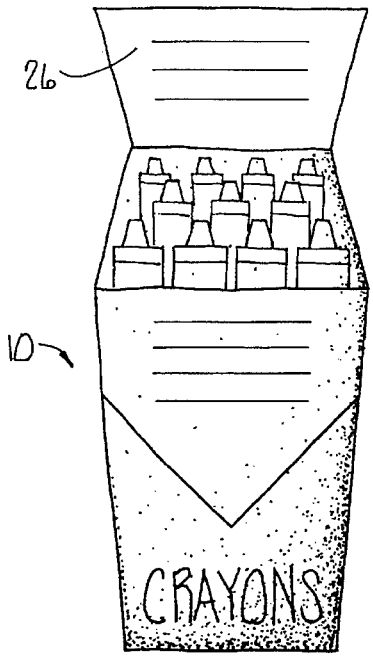
FIG. 15B is a front view of an inflatable balloon shaped as a box of crayons with the flap member in the second position to create the image of a box of crayons with the lid open.
Figure 11A:
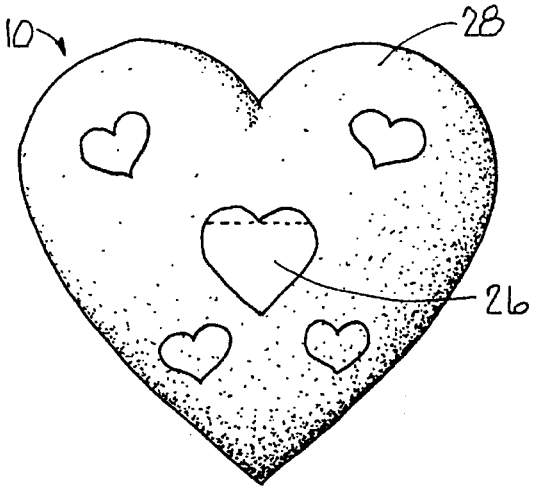
FIG. 11A is a front view of an inflatable balloon shaped as a heart with the flap member shaped as a heart in the first position to conceal a typographical message under the flap member.
Figure 11B:
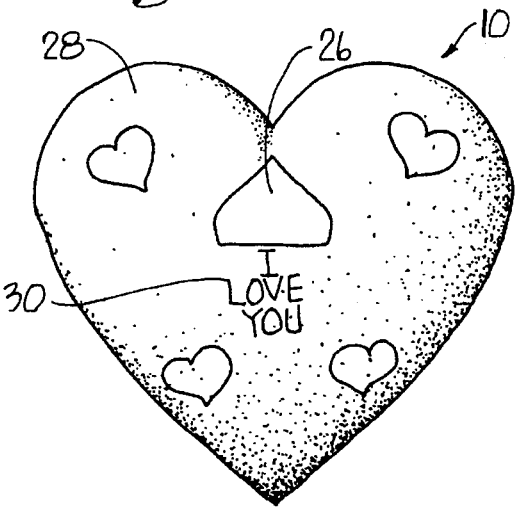
FIG. 11B is a front view of an inflatable balloon shaped as a heart with the flap member shaped as a heart in the second position to expose a typographical message under the flap member.
Figure 13A:
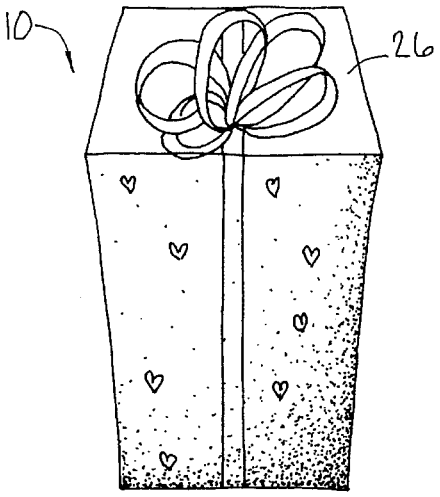
FIG. 13A is a front view of an inflatable balloon shaped as a present with the flap member in the first position to create the image of a boxed present with the lid closed.
Figure 13B:
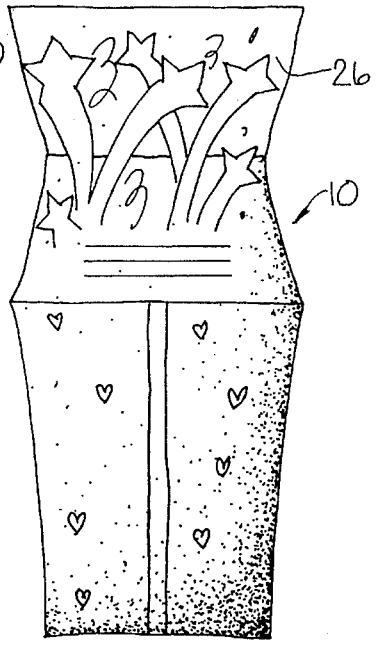
FIG. 13B is a front view of an inflatable balloon shaped as a boxed present with the flap member in the second position to create the image of a boxed present with the lid open.
Figure 14B:
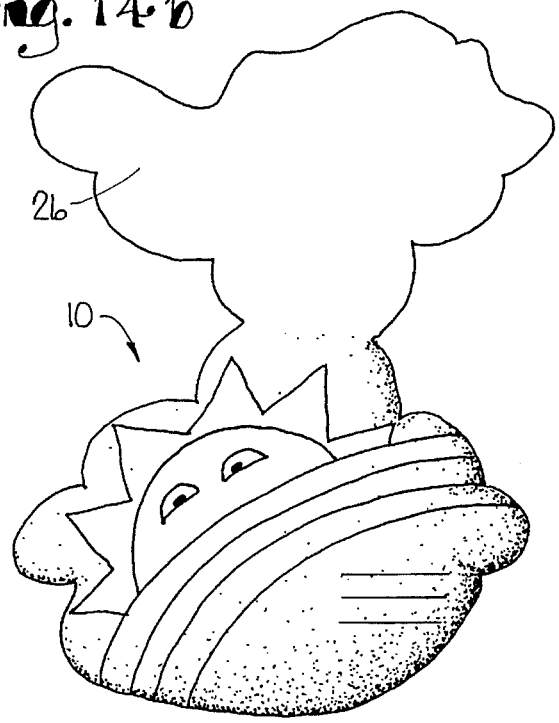
FIG. 14B is a front view of an inflatable balloon shaped as a rainbow and cloud with the flap member in the second position to expose the sun behind the rainbow.
Figure 14A:
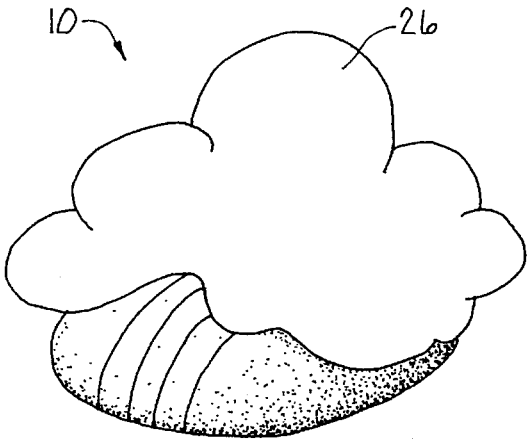
FIG. 14A is a front view of an inflatable balloon shaped as a rainbow and cloud with the flap member in the first position.

Referring to FIG. 17, inflatable chamber 20 is further comprised of first wall 50 and second wall 52. First wall 50 has interior side 54 and exterior side 56. Second wall 52 is comprised of interior side 60 and exterior side 58. Graphic design 24 (not shown) may be placed on either wall (50 or 52) or a combination of both, on the exterior side (58 or 56) or on the interior side (54 or 60) or any available combination. The only limiting factor is that at least a portion of the design should be visible. For example, if graphic design is placed on interior side 54 of first wall 50, then at least a portion of second wall 52 must be transparent such that at least a portion of graphic design is visible. If graphic design 24 is placed on interior side 60 of second wall 52, then at least a portion of first wall 50 must be transparent such that at least a portion of graphic design is visible. An inflatable balloon with a graphic design on the interior side of one wall while the other wall is transparent is known as a DimensionAir. (DimensionAir is a trademark of Continental American Corporation d/b/a Pioneer Balloon Company)

Inflatable balloon 10 may be made of Microfoil aluminized film (MICROFOIL is a registered trademark of Continental American Corporation d/b/a Pioneer Balloon Company) or latex, the preferred being Microfoil. Flap member 26 is generally made of the same material as inflatable balloon 10 although if the design requires a different material, such material would be used. All sizes and shapes of inflatable balloons are possible as the Figures and the above description illustrate.

Although the invention has been described with reference to specific embodiments, this description is not meant to be construed in a limited sense. Various modifications of the disclosed embodiments, as well as alternative embodiments of the inventions will become apparent to person skilled in the art upon the reference to the description of the invention. It is, therefore, contemplated that the appended claims will cover such modifications that fall within the scope of the invention.

What is claimed and desired to be secured by Letters Patent is as follows:

1. An inflatable balloon, comprising:

a. an inflatable chamber;

b. a graphic design on at least a portion of said inflatable chamber;

c. at least one non-inflated flap member adjoining said inflatable chamber and hanging down limply over a portion of said inflatable chamber;

d. said flap member having a first position and a second position, wherein i. said first position conceals at least a portion of said graphic design on said inflatable chamber to yield a concealed portion and a non-concealed portion; and ii. said second position allows said concealed portion of said graphic design to be exposed iii. a. said flap is comprised of a front face and a back face, said back face being proximate to said inflatable chamber when said flap member is in said first position;

b. at least a portion of said back face of said flap member having a graphic design complimentary to at least a portion of said graphic design on said on inflatable chamber.

2. The inflatable balloon of claim 1, wherein said flap member is comprised of:

a. a front face and a back face, said back face being proximate to said inflatable chamber when said flap member is in said first position;

b. at least a portion of said front face of said flap member having a graphic design complimentary to at least a portion of said graphic design on said inflatable chamber.

3. The inflatable balloon of claim 1, wherein said flap member is comprised of:

a. a front face and a back face, said back face being proximate to said inflatable chamber when said flap member is in said first position;

b. at least a portion of said front face of said flap member having a graphic design complimentary to at least a portion of said non-concealed portion of said graphic design on said inflatable chamber.

4. The inflatable balloon of claim 1, wherein said flap member is comprised of:

a. a front face and a back face, said back face being proximate to said inflatable chamber when said flap member is in said first position;

b. at least a portion of said back face of said flap member having a graphic design complimentary to at least a portion of said concealed portion of said graphic design on said inflatable chamber.

5. The inflatable balloon of claim 1, wherein said flap member is comprised of:

a. a front face and a back face, said back face being proximate to said inflatable chamber when said flap member is in said first position;

b. at least a portion of said back face of said flap member having a graphic design complimentary to at least a portion of said concealed portion of said graphic design on said inflated balloon; and c. at least a portion of said front face of said flap member having a graphic design complimentary to at least a portion of said non-concealed portion of said graphic design on said inflatable chamber.

6. The inflatable balloon of claim 1, wherein a. said inflatable chamber has an animal shape; and b. said graphic design on said animal shaped inflatable chamber compliments said animal shape to create a physical image of an animal.

7. The inflatable balloon of claim 1, wherein a. said inflatable chamber has a human shape; and b. said graphic design on said human shaped inflatable chamber compliments said human shape to create a physical image of a human.

8. The inflatable balloon of claim 5, wherein a. said inflatable chamber has an animal shape; and b. said graphic design on said exterior side of said animal shaped inflatable chamber compliments said animal shape to create a physical image of an animal.

9. The inflatable balloon of claim 5, wherein a. said inflatable chamber has a human shape; and b. said graphic design on said human shaped inflatable chamber compliments said human shape to create a physical image of a human.

10. The inflatable balloon of claim 8, wherein a. at least a portion of said graphic design on said back face of said flap member and at least a portion of said concealed portion of said graphic design on said inflatable chamber create the image of an animal with an open mouth when said flap member is in said second position; and b. at least a portion of said graphic design on said front face of said flap member and at least a portion of a non-concealed portion of said graphic design on said inflatable chamber create the image of an animal with a closed mouth when said flap member is in said first position.

11. The inflatable balloon of claim 1, wherein at least a portion of said concealed portion of said graphic design on said inflatable chamber is a typographical message.

12. The inflatable balloon of claim 1 further comprising a plurality of flap members.

13. An inflatable balloon, comprising:

a. an inflatable chamber having a first wall and a second wall;

i. said first wall having an interior side and an exterior side;

ii. said second wall having an interior side and an exterior side;

iii. said interior side of said first wall being proximate to said interior side of said second wall;

b. a graphic design on at least a portion of said exterior side of said first wall of said inflatable chamber;

c. at least one non-inflated flap member adjoining said exterior side of said first wall of said inflatable chamber;

d. said flap member having a first position and a second position, wherein i. said first position hangs down limply over a portion of said inflatable chamber and conceals at least a portion of said graphic design on said exterior side of said first wall of said inflatable chamber to yield a concealed portion and a non-concealed portion; and ii. said second position allows said concealed portion of said graphic design to be exposed; and e. said flap member comprised of:

i. a front face and a back face, said back face being proximate to said exterior side of said first wall of said inflatable chamber when said flap member is in said first position;

ii. at least a portion of said front face of said flap member having a graphic design complimentary to at least a portion of said graphic design on said exterior side of said first wall of said inflatable chamber.

14. The inflatable balloon of claim 13, wherein a. at least a portion of said front face of said flap member has a graphic design complimentary to at least a portion of said non-concealed portion of said graphic design on said exterior side of said first wall of said inflatable chamber; and b. at least a portion of said back face of said flap member has a graphic design complimentary to at least a portion of said concealed portion of said graphic design on said exterior side of said first wall of said inflatable chamber.

15. The inflatable balloon of claim 14, wherein at least a portion of said concealed portion of said graphic design on said exterior side of said first wall of said inflatable chamber is a typographical message.

16. The inflatable balloon of claim 13, wherein a. said inflatable chamber has an animal shape;

b. said graphic design on said exterior side of said first wall of said animal shaped inflatable chamber compliments said animal shape to create a physical image of an animal;

c. at least a portion of said graphic design on said back face of said flap member and at least a portion of said concealed portion of said graphic design on said exterior side of said first wall of said inflatable chamber create the image of an animal with an open mouth when said flap member is in said second position; and d. at least a portion of said graphic design on said front face of said flap member and at least a portion of said non-concealed portion of said graphic design on said exterior side of said first wall of said inflatable chamber create the image of an animal with a closed mouth when said flap member is in said first position.

17. An inflatable balloon, comprising:

a. an inflatable chamber having a first wall and a second wall;

i. said first wall having an interior side and an exterior side;

ii. said second wall having an interior side and an exterior side;

iii. said interior side of said first wall being proximate to said interior side of said second wall;

b. a graphic design on at least a portion of said interior side of said first wall of said inflatable chamber and at least a portion of said second wall being transparent such that at least a portion of said graphic design on said interior of said first wall of said inflatable chamber is visible;

c. at least one non-inflated flap member adjoining said exterior side of said second wall of said inflatable chamber;

d. said flap member having a first position and a second position, wherein i. said first position hangs down limply over a portion of said inflatable chamber and conceals at least a portion of said graphic design on said interior side of said first wall of said inflatable chamber to yield a concealed portion; and ii. said second position allows said concealed portion of said graphic design to be exposed; and e. said flap member comprised of:

i. a front face and a back face, said back face being proximate to said exterior side of said second wall of said inflatable chamber when said flap member is in said first position;

ii. at least a portion of said front face of said flap member having a graphic design complimentary to at least a portion of said graphic design on said interior side of said first wall of said inflatable chamber.

18. An inflatable balloon, comprising:

a. an inflatable chamber;

b. a graphic design on at least a portion of said inflatable chamber;

c. a non-inflatable flap member adjoining said inflatable chamber and hanging down limply over a portion of said inflatable chamber;

d. said non-inflatable flap member having a first position and a second position, wherein i. said first position conceals at least a portion of said graphic design on said inflatable chamber to yield a concealed portion and a non-concealed portion; and ii. said second position allows said concealed portion of said graphic design to be exposed;

e. said non-inflatable flap member comprised of:

i. a front face and a back face, said back face being proximate to said inflatable chamber when said flap member is in said first position;

ii. at least a portion of said front face of said flap member having a graphic design complimentary to at least a portion of said non-concealed portion of said graphic design on said inflatable chamber;

iii. at least a portion of said back face of said flap member having a graphic design complimentary to at least a portion of said concealed portion of said graphic design on said inflatable chamber; and iv. means for adding shape to said flap member.

* * * * *